US006915534B1

(12) United States Patent
Johannes

(10) Patent No.: US 6,915,534 B1
(45) Date of Patent: Jul. 12, 2005

(54) INSULATED COVER AND METHOD FOR USING SAME

(75) Inventor: Michael J. Johannes, Ames, IA (US)

(73) Assignee: Chamness Technology, Inc., Blairsburg, IA (US)

( * ) Notice: Subject to any disclaimer, the term of this patent is extended or adjusted under 35 U.S.C. 154(b) by 0 days.

(21) Appl. No.: 10/687,008

(22) Filed: Oct. 16, 2003

(51) Int. Cl.[7] ..... E04H 4/00
(52) U.S. Cl. ..... 4/498; 4/506
(58) Field of Search ..... 4/498, 499, 503, 4/506

(56) References Cited

U.S. PATENT DOCUMENTS 3,313,443 A * 4/1967 Dial et al. ..... 4/498
3,661,688 A * 5/1972 Wheeler ..... 428/54
3,683,428 A * 8/1972 Morris ..... 4/498
3,927,427 A * 12/1975 Aine ..... 4/499
4,028,750 A * 6/1977 Gustafsson ..... 4/498
5,400,549 A * 3/1995 Morgan ..... 4/498
5,546,615 A 8/1996 Chamness
6,047,415 A * 4/2000 Brown ..... 4/498
6,723,954 B2 * 4/2004 Nikodym et al. ..... 219/130.1

FOREIGN PATENT DOCUMENTS

JP 62-279086 * 3/1987

* cited by examiner

*Primary Examiner*—Khoa D. Huynh
(74) *Attorney, Agent, or Firm*—McKee, Voorhees & Sease, P.L.C.

(57) ABSTRACT

A cover for a pool includes a plurality of panels joined together by welding one another together to form a single blanket. The blanket is in covering relation over the fluid within a pool basin and a plurality of holes formed in the lateral layers of each panel within the blanket permit water to drain through holes from above the blanket and also permit gasses to rise from the fluid within the lagoon upwardly through the holes in the blanket. The method of the present invention comprises welding the various panels together to form the blanket in a shape which conforms to the shape of the pool.

23 Claims, 3 Drawing Sheets

INSULATED COVER AND METHOD FOR USING SAME

BACKGROUND OF THE INVENTION

The present invention relates to an insulated cover and method for using same.

There are numerous applications for providing an insulated cover over a pool or lagoon. Insulated covers have been used over swimming pools to maintain the temperature of the pool overnight or during cool seasons. Other insulated covers have been provided over lagoons or pools which are used for digesting sludge and other contaminates for waste materials. In these lagoons it is desirable to provide a cover over the lagoon so as to maintain an appropriate temperature within the lagoon to enable bacteria to decompose the materials and solution in the lagoon.

One problem encountered with covers or blankets for a pool or lagoon is the ability to customize the shape of the cover so that it fits the particular shape of the pool or lagoon. U.S. Pat. No. 5,546,615 illustrates a cover which is comprised of a plurality of panels that are joined together at their edges. The panels are joined by cables extending through grommets in the lateral sides of each panel. These cables require anchoring in the ground along the edges of the pool or lagoon, and such anchoring requires the formation of concrete anchors having eyelets for receiving the cables and tying the cables. The cables extending through the grommets to join the various panels together are rough and are time consuming to fasten and tie.

Therefore a primary object of the present invention is the provision of an improved insulated cover and method for using same.

A further object of the present invention is the provision of an improved insulated cover and method for using same which welds the adjacent lateral edges of the panels together to form a blanket.

A further object of the present invention is the provision of an improved insulated cover and method for using same wherein the lateral edges of the panels are overlapped and are heat sealed in the interface between the overlapping edges in addition to the formation of a weld at the overlapping edges.

A further object of the present invention is the provision of an improved insulated cover and method for using same which includes holes between the various insulated panels for permitting water to drain downwardly from the upper surface of the blanket to the lower surface of the blanket and also for permitting gasses to escape from beneath the lower surface of the blanket to the upper surface of the blanket.

A further object of the present invention is the provision of an insulated cover and method for using same which includes parametric edges extending around a blanket, the parametric edges being embedded within trenches around the perimeter of the lagoon or pool, and with dirt being packed over the embedded edges within the trenches so as to anchor the edges of the blanket.

A further object of the present invention is the provision of an improved insulated cover and method for using same which is economical to manufacture, durable in use, and efficient in operation.

BRIEF SUMMARY OF THE INVENTION

The foregoing objects may be achieved by a cover for a pool having a pool basin, a quantity of fluid within the pool basin, and a soil surrounding the pool basin. The cover includes a plurality of panels, each having an upper layer, a lower layer, and an insulation material sandwiched between the upper layer and the lower layer. The panels each have a lateral layer extending laterally from the sandwiched insulation material. Each of the lateral layers includes an upper surface and a lower surface. Each of the plurality of panels has pairs of the lateral layers welded to one another to form a singular blanket from the plurality of panels. The blanket is in covering relation over the fluid within the pool basin. A plurality of holes formed in the lateral layers permit water to drain through the holes from above the blanket to below the blanket. These holes also permit gasses to rise from the fluid within the pool basin upwardly through the holes to above the blanket.

The term "pool" is utilized with respect to this invention. This term is intended to include any type of swimming pool, lagoon, or other pool which requires insulated covers for maintaining the temperature of the fluid during cold weather. The term includes lagoons used for holding waste fluids for decomposing.

According to another feature of the present invention the pairs of lateral layers are welded together and each comprise an overlapped portion comprising an upper surface of one of the lateral layers in each of the pairs in contact with the lower surface of the other of the lateral layers in each of the pairs.

According to another feature of the present invention a weld joint overlies and contacts a portion of the upper surface of one of the lateral layers in each of the pairs and overlying and contacting a portion of the upper surface of the other of the lateral layers in each of the pairs.

According to another feature of the present invention the overlapping upper surface of one of the lateral layers within each of the pairs and the lower surface of the other of the lateral layers within each of the pairs are heat sealed together.

According to another feature of the present invention the blanket includes a perimeter edge extending there around. The perimeter edge is anchored to the soil surrounding the pool basin.

According to another feature of the present invention the perimeter edge of the blanket is at least partially within a trench surrounding the lagoon, and a quantity of soil is in the trench to anchor the perimeter edge of the blanket.

The method of the present invention comprises overlapping the lateral layers of a first panel and a second panel of the plurality of panels so that an interface portion on the lower surface on one of the lateral layers contacts an interface portion of the upper surface of an adjacent lateral layer. A weld joint is formed that overlaps a portion of the upper surface of the first panel lateral layer and a portion of the upper surface of the second panel lateral layer so as to join the first and second panels together.

According to another feature of the present invention each of the panels are joined together in the manner described above to form a blanket comprising the plurality of panels.

According to another feature of the present invention a plurality of holes are formed in the lateral layers of the panel so as to permit water to drain through the holes from above the blanket to below the blanket and so as to permit gasses to rise from the fluid within the pool basin upwardly through the holes to above the blanket.

According to the another feature of the method of the present invention the interface portions of the first and second panels are heated so that they become tacky and adhere to one another. The heating step is performed before the step of forming a weld joint.

According to another feature of the present invention a hole is formed through the lateral layer of one of the first and second panels to permit water to drain through the hole from above to below the first and second panels and to permit gasses to rise through the hole from below to above the first and second panels.

DETAILED DESCRIPTION OF THE PREFERRED EMBODIMENT

Figure 1:
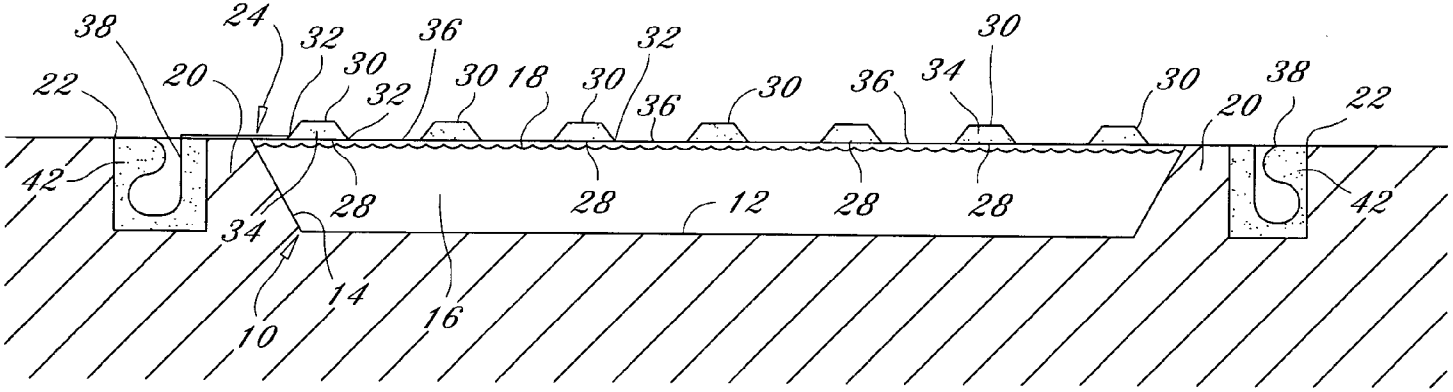
FIG. 1 is a sectional view through a lagoon or pool of the present invention.
Figure 3:
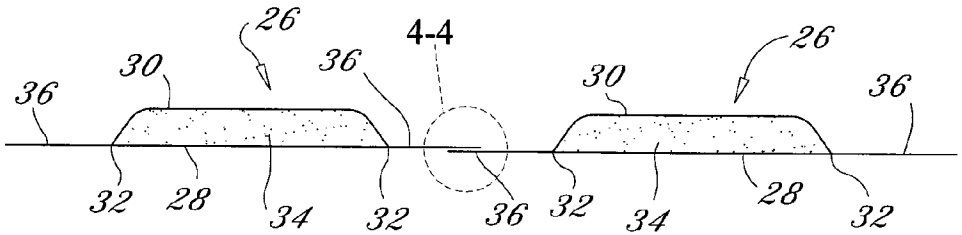
FIG. 3 is a detail sectional view showing the first steps of overlapping the adjacent edges of two panels 26.

Referring to FIG. 1 a lagoon or pool 10 is shown. While lagoon 10 may be formed in dirt, it is also possible to use the blanket of the present invention for covering swimming pools or the like, and therefore the term "pool" as used herein means a swimming pool, a lagoon for containing waste material, or any other type of pool requiring an insulated cover.

Pool 10 includes a bottom wall 12 having a plurality of side walls 14. The side walls 14 may be vertical or slanted depending upon the particular configuration of the lagoon or pool. The bottom wall 12 and the side walls 14 form a pool basin 16 which is adapted to contain a fluid 18. The fluid 18 may be waste material, or it may be the water of a swimming pool, or it could be a fluid within any type of pool requiring an insulated cover.

Surrounding the lagoon or pool 10 is dirt or ground 20. The dirt or ground 20 includes a perimeter trench 22 which surrounds the pool 10.

A blanket 24 is in covering relation over the upper surface of the fluid 18 within the pool basin 16.

Blanket 24 is formed from a plurality of panels 26 which are joined together in the manner described below the joined lateral edges. Each of the panels 26 are shown in detail in FIGS. 3–6. Each panel 26 includes a lower layer 28 and an upper layer 30. The upper layer 30 includes welded edges 32 which are welded at the factory and which include an insolative material 34 between the upper and lower layers 28, 30. The insulative material is completely enclosed within the double panel formed by lower layer 28 and upper layer 30.

The lower layer 28 extends laterally outwardly from the welds 32 to form lateral panel edges 36 which extend around the entire perimeter of the each panel 26. While the lateral edges 36 are formed by extensions of lower layer 28, they could also be formed by extensions of upper layer 30 or they could be joined to the lower layer 28 and extend laterally outwardly therefrom.

The blanket 24 includes a perimeter edge 38 which extends around the outer perimeter of the blanket 24. The perimeter layer 38 is joined to the other panels 26 by means of elongated weld joints 40, and the edges of the panels 26 are each joined together along elongated welded joints 40 as well. The perimeter edge 38 of blanket 24 extends within the perimeter trench 22 and fill dirt 42 is packed around the perimeter edge 38 so as to anchor the blanket at the edges of the pool or lagoon 10 and thereby provide a cover for the fluid 18 within the pool basin 16.

The method for forming the weld 40 is shown in FIGS. 3–6. The first step in welding the lateral edges 36 of the panels together is to overlap the lateral edges 36 in the manner shown in FIG. 3.

Figure 4:
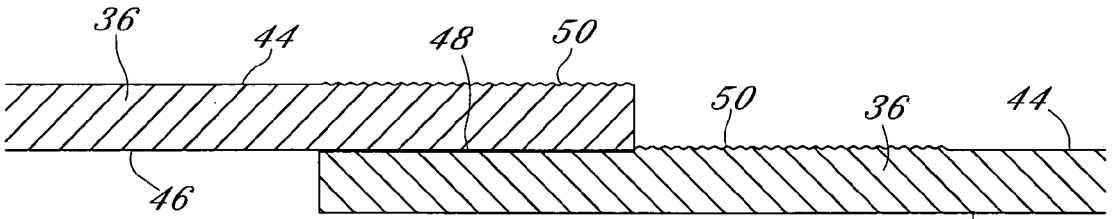
FIG. 4 is an enlarged view taken along line 4—4 of FIG. 3.

FIG. 4 shows the formation of a heat sealed interface 48 between an upper surface 44 of one panel (on the right in FIG. 4) and a lower surface 46 of the other panel (on the left in FIG. 4). This heat sealed interface 48 is formed by a heat sealing device known as a leister triac unit, model number CH-6060SAMEN, sold by Winkleman Sales Inc., in Buffalo, N.Y. 14220. This tool applies heat to the adjoining upper surface of the right hand lateral edge 36 and the lower surface 46 of the left hand lateral layer 36 as shown in FIG. 4. Heat is applied until the lateral layers 36 are partially melted and then they are joined together by pressing so as to form a heat seal 48 there between. The lateral layers 36 are formed of a plastic material which is easily heat sealed. Also shown in FIG. 4 are a plurality of ground or roughed up surfaces 50 adjacent the overlapping layers 36. The roughed up portions 50 are both on the upper surfaces 44 of the two adjoining panels 36, and are approximately 1 to 2 inches wide.

Figure 5:
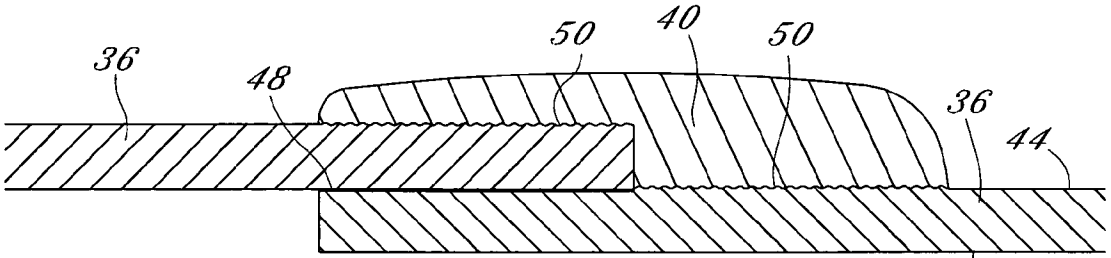
FIG. 5 is a view similar to FIG. 4, but showing the formation of the weld at the overlapping edges.

FIG. 5 shows the application of a weld material to create the weld joint 40 over the roughed up surfaces 50. A tool for forming the weld joint 40 is an extrusion welding gun, model X2-SC EX, manufactured by Plastic Wekling Technologies International in Diamond Springs, California. This welding gun melts a rope material formed from plastic that deposits the weld 40 over the roughed up surfaces 50 of the panels 36, thereby securely joining the layers 36 together as shown in FIGS. 5 and 6.

Figure 2:
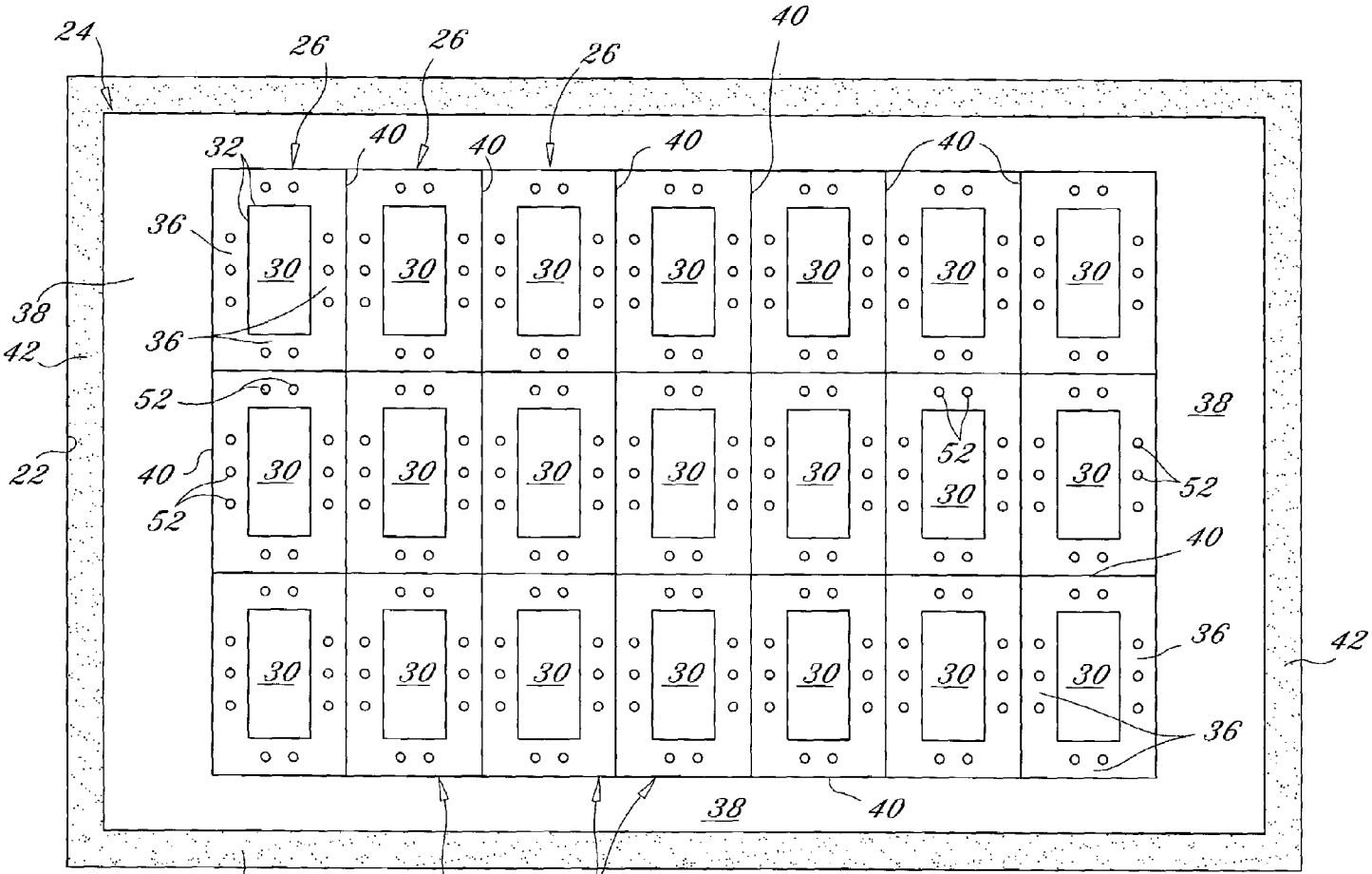
FIG. 2 is a top plan view of the lagoon or pool shown in FIG. 1.
Figure 6:
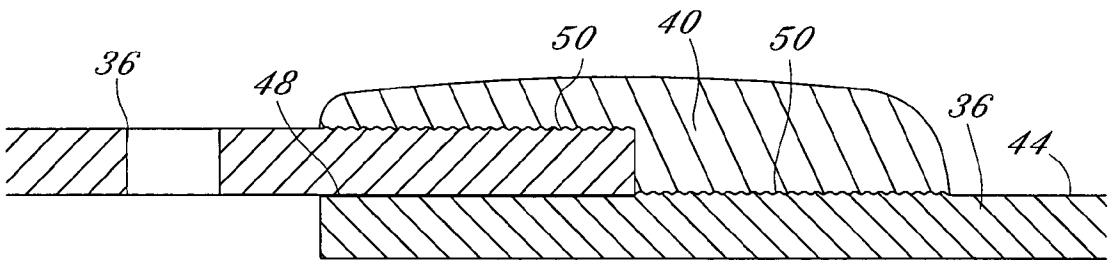
FIG. 6 is a view similar to FIG. 5, but showing the formation of a hole in one of the lateral edges of the panels.

FIG. 6 shows the formation of a hole 52 in one of the lateral edges 36 that have been joined together by weld 40. As can be seen in FIG. 2, the holes 52 are formed along the sides of each panel 30 in a plurality of places. Holes 52 provide an important function to the blanket 24. They permit rain water or other water to drain downwardly through the holes 52 from the upper surface of the blanket 24 to the fluid 18 within the lagoon basin 16. At the same time, these holes 52 permit gasses to escape from the fluid 18 within the lagoon basin 16 upwardly through the holes 52 to escape above the blanket 24.

The present invention provides a very strong blanket which can float on the upper surface of the fluid 18 within the lagoon basin 16 while at the same time permitting water to drain through the holes 52 and permitting gasses to escape upwardly through the holes 52. The use of a trench 22 around the perimeter of pool basin 16 also provides an improved means for anchoring the outer perimeter edges of the blanket so as to maintain the blanket in place over the pool.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstance may suggest or render expedient without departing from the spirit or scope of the invention as further defined in the following claims.

What is claimed is:

1. A method for covering a pool having a pool basin and a quantity of fluid within the pool basin, the method comprising:

taking a plurality of panels, each having an upper layer, a lower layer, and an insulation material sandwiched between the upper layer and the lower layer, the panels each having a lateral layer extending laterally from the sandwiched insulation material, each of the lateral layers having an upper surface and a lower surface;

overlapping the lateral layers of a first panel and a second panel of the plurality of layers so that an interface portion on the lower surface of the first panel contacts an interface portion of the upper surface of the second panel;

forming a weld and depositing a weld joint that overlaps a portion of the upper surface of the first panel and a portion of the upper surface of the second panel so as to join the first and second panels together.

2. The method according to claim 1 and further comprising heating the interface portions of the first and second panels so that they become tacky and adhere to one another, the heating step being performed before the step of forming a weld joint.

3. The method according to claim 2 and further comprising forming a hole through the lateral layer of one of the first and second panels to permit water to drain through the hole from above to below the first and second panels and to permit gases to rise through the hole from below to above the first and second panels.

4. The method according to claim 1 and further comprising joining the plurality of panels together by the same steps for joining the first and second panels together so as to create a blanket from the plurality of panels.

5. The method according to claim 4 and further comprising placing the blanket in covering relation over the quantity of fluid within the pool basin, and forming a plurality of holes in at least one of the lateral layers between each of the plurality of panels so as to permit water to drain through the hole from above to below the blanket and so as to permit gases to rise through the hole from below to above the blanket.

6. The method according to claim 5 wherein soil surrounds the pool basin, the blanket including a perimeter edge extending around the perimeter of the blanket, the method further comprising anchoring the perimeter edge of the blanket to the soil surrounding the pool basin so as to secure the blanket in covering relation over the fluid within the pool basin.

7. The method according to claim 6 wherein the anchoring of the perimeter edge of the blanket to the soil is accomplished by excavating a trench in the soil, placing the perimeter edge within the trench, and filling the trench with soil so as to anchor the perimeter edge within the trench.

8. The method according to claim 1 further comprising roughing up a portion of the upper surface of the first panel and the second panel before forming the weld joint.

9. The method according to claim 1 wherein the weld joint is a melted plastic material.

10. The method according to claim 1 wherein the weld joint is deposited over a roughed up surface.

11. A method for covering a pool having a pool basin and a quantity of fluid within the pool basin, the method comprising:

taking a plurality of panels, each having an upper layer, a lower layer, and an insulation material sandwiched between the upper layer and the lower layer, the panels each having a lateral layer extending laterally from the sandwiched insulation material, each of the lateral layers having an upper surface and a lower surface;

overlapping and welding the lateral layers of the panels together so as to form a single blanket from the plurality of panels and depositing a weld joint that overlaps a portion of the upper surface of the first panel and a portion of the upper surface of the second panel;

forming a plurality of holes in the lateral layers of the panels so as to permit water to drain through the holes from above the blanket to below the blanket and so as to permit gases to rise from the fluid within the pool basin upwardly through the holes to above the blanket;

placing the blanket in covering relation over the fluid within the pool basin.

12. The method according to claim 11 and further comprising placing the lateral layers of adjacent ones of the plurality of panels in overlapping relationship so that the upper surface of one of the lateral layers is below and touching the lower surface of the other of the lateral layers, the welding step comprising forming a weld joint over the upper surface of one of the overlapped lateral layers and over the upper surface of the other of the overlapped lateral layers.

13. The method according to claim 12 and further comprising heating the overlapping upper and lower surfaces of the overlapping lateral layers so that the overlapping upper and lower surfaces partially melt and join together, the heating step being accomplished before the welding step.

14. The method according to claim 11 further comprising roughing up a portion of the upper surface of the first panel and a second panel before forming the weld joint.

15. The method according to claim 11 wherein the weld joint is deposited over a roughed up surface.

16. The method according to claim 11 wherein the weld joint is a melted plastic material.

17. A cover for a lagoon having a pool basin and a quantity of fluid within the pool basin, the cover comprising:

a plurality of panels, each having an upper layer, a lower layer, and an insulation material sandwiched between the upper layer and the lower layer, the panels each having a lateral layer extending laterally from the sandwiched insulation material, each of the lateral layers having an upper surface and a lower surface;

each upper surface roughed up to receive a deposited weld joint;

each of the plurality of panels having pairs of the lateral layers thereof welded to one another forming a weld with said deposited weld joint that is partially covering the upper surfaces of the upper layer of a first panel and a second panel, to form a singular blanket from the plurality of panels wherein the lateral layers of the first panel overlapping the lateral layers of the second panel;

the blanket being in covering relation over the fluid within the pool basin;

a plurality of holes formed in the lateral layers for permitting water to drain through the holes from above the blanket to below the blanket and so as to permit gases to rise from the fluid within the pool basin upwardly through the holes to above the blanket.

18. The cover according to claim 17 and wherein the pairs of lateral layers welded to one another each comprise an overlapped portion comprising the upper surface of one of the lateral layers in each of the pairs in contact with the lower surface of the other of the lateral layers in each of the pairs.

19. The cover according to claim 18 and further comprising the weld joint overlying and contacting a portion of the upper surface of one of the lateral layers in each of the pairs and overlying and contacting a portion of the upper surface of the other of the lateral layers in each of the pairs.

20. The cover according to claim 18 and further comprising the overlapping upper surface of one of the lateral layers within each of the pairs and lower surface of the other of the lateral layers within each of the pairs are heat sealed together.

21. The cover according to claim 17 wherein soil surrounds the pool basin, the blanket including a perimeter edge extending there around, the perimeter edge being anchored to the soil surrounding the pool basin.

22. The cover according to claim 21 wherein a trench is in the soil surrounding the pool basin, the perimeter edge of the blanket being at least partially within the trench, and a quantity of soil also being in the trench to anchor the perimeter edge of the blanket.

23. The cover according to claim 17 wherein the weld joint is a melted plastic material.

* * * * *